US010118276B1

(12) United States Patent
Miller

(10) Patent No.: US 10,118,276 B1
(45) **Date of Patent: *Nov. 6, 2018**

(54) MEDIA-BEARING POLISHER AND RESTORER

(71) Applicant: Timothy D. Miller, Huntington Beach, CA (US)

(72) Inventor: Timothy D. Miller, Huntington Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/913,265

(22) Filed: Mar. 6, 2018

Related U.S. Application Data

(63) Continuation of application No. 14/525,518, filed on Oct. 28, 2014, now Pat. No. 9,908,218, which is a continuation-in-part of application No. 29/469,421, filed on Oct. 10, 2013, now Pat. No. Des. 716,631.

(51) Int. Cl.
*B24D 15/04* (2006.01)
*B24D 15/02* (2006.01)

(52) U.S. Cl.
CPC ..... *B24D 15/04* (2013.01); *B24D 15/023* (2013.01)

(58) Field of Classification Search
CPC ..... B24D 15/00; B24D 15/02; B24D 15/023; B24D 15/04; B60S 3/045
See application file for complete search history.

(56) References Cited

U.S. PATENT DOCUMENTS 4,202,139 A * 5/1980 Hong ..... B24D 15/045 15/227
5,259,914 A * 11/1993 Fisher ..... B24B 23/02 156/714
D405,572 S * 2/1999 Bouchez ..... D32/40
5,879,504 A * 3/1999 Winter ..... B24D 13/12 15/3.53
6,083,345 A * 7/2000 Frank ..... B08B 1/04 15/3.53
6,267,658 B1 * 7/2001 Ali ..... B24D 15/02 451/523
D478,351 S * 8/2003 Belton ..... D19/187
6,688,958 B1 * 2/2004 Jones ..... B24D 15/00 451/345
6,899,608 B2 * 5/2005 Huang ..... B24D 15/023 451/356
D587,089 S * 2/2009 Ali ..... D8/90
D607,297 S * 1/2010 Ali ..... D8/90
D644,030 S * 8/2011 Gates ..... D4/137
8,308,532 B2 * 11/2012 Usui ..... B24D 15/04 451/523
8,430,724 B2 * 4/2013 Heilian ..... B24D 11/00 15/229.11
D687,286 S * 8/2013 Ali ..... D8/90

(Continued)

*Primary Examiner* — Timothy V Eley
(74) *Attorney, Agent, or Firm* — Lightbulb IP, LLC

(57) ABSTRACT

A media-bearing polisher and restorer removes surface and subsurface contaminants from one or more vehicle surfaces. In one or more embodiments, the media-bearing polisher and restorer comprises a body having a hemispherical shape. The body comprises a resilient or rigid material and one or more flutes for receiving one or more user fingers. One or more mediums, which absorbs and extracts contaminants from the surface, are attached to a bottom of the hemispherical body. A variety of media may be used with the media-bearing polisher and restorer.

5 Claims, 4 Drawing Sheets

(56) References Cited

U.S. PATENT DOCUMENTS

| | | | | |
|---|---|---|---|---|
| D707,525 | S * | 6/2014 | Ali | D8/90 |
| D726,384 | S * | 4/2015 | Jenden | D32/52 |
| 9,272,393 | B2 * | 3/2016 | Ali | B24D 15/023 |
| 2008/0098546 | A1 * | 5/2008 | Warmka | A47L 13/16 15/104.94 |

* cited by examiner

MEDIA-BEARING POLISHER AND RESTORER

CROSS-REFERENCE TO RELATED APPLICATION

This application is a continuation of U.S. patent application Ser. No. 14/525,518, filed Oct. 28, 2014, which is a continuation-in-part of U.S. patent application Ser. No. 29/469,421, filed Oct. 10, 2013.

BACKGROUND OF THE INVENTION

Field of the Invention

The invention relates to vehicle detailing and in particular to a media-bearing polisher and restorer for use on vehicle surfaces.

Related Art

Detailing is a popular activity used to restore a vehicle's appearance, improve a vehicle's appearance or both. Consistent exposure to the elements has an effect on the appearance of a vehicle. For instance, a vehicle will become dirty simply through normal use. Though this "dirt" can be removed with cleaning there remains some surface contaminants that are not removed by cleaning.

Various materials and methods have been developed to remove contaminants that are not typically removed by cleaning. Typically, these materials and methods utilize an abrasive that is more aggressive than a cleaner, such as soap, to remove such contaminants.

For example, at a higher end of aggressiveness traditional sanding blocks can be used to remove containments, unwanted paint or both from a vehicle surface. Alternatively, polishing compounds having a milder abrasive quality may be used. Traditionally, these are applied using sponges, cloth or towels. A detailer or other user must exercise care when utilizing these methods to avoid damaging a vehicle by over abrading its surface.

From the discussion that follows, it will become apparent that the present invention addresses the deficiencies associated with the prior art while providing numerous additional advantages and benefits not contemplated or possible with prior art constructions.

SUMMARY OF THE INVENTION

A media-bearing polisher and restorer that removes surface and subsurface contaminants from a vehicle surface is disclosed herein. As disclosed herein, a media-bearing polisher and restorer may be constructed in various ways in its various embodiments.

Various embodiments of the media-bearing polisher and restorer and methods therefor are disclosed herein. For instance, in one exemplary embodiment, a media-bearing polisher and restorer for one or more vehicle surfaces comprises a body having an ovoid shape with a planar bottom, one or more flutes formed in an exterior surface of the body at the top of the body, and one or more media at the planar bottom. The media comprise an elastomeric material having a continuous non-abrasive surface for application to the vehicle surfaces. A resilient pad may be provided between the media and the planar bottom. In addition, the media may comprise one or more contours to correspond to a portion of the vehicle surfaces.

In another exemplary embodiment, a media-bearing polisher and restorer for one or more vehicle surfaces comprises a body having a hemispherical shape, one or more flutes formed in an exterior surface of the body at the top of the body, and one or more media at a bottom of the body. The media comprise an elastomeric material having a continuous non-abrasive surface for application to the vehicle surfaces. Similar to above, a resilient pad may be provided between the media and the planar bottom.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The media-bearing polisher and restorer herein facilitates removal of contaminants that are lodged in a vehicle surface, which typically cannot be removed by cleaning, while also reducing the risk of misapplication of its media to the vehicle surface. As will be disclosed further below, the media-bearing polisher and restorer comprises an applicator or body portion that secures and holds removable and replaceable media for removing contaminants from various vehicle surfaces. Though described herein with regard to vehicle surfaces, it is noted that the media-bearing polisher and restorer may be used to polish and restore other surfaces as well.

A media-bearing polisher and restorer can polish and restore painted surfaces, coated surfaces, uncoated surfaces (e.g., natural or artificial stone, tile, stainless steel, hard plastics, glass, acrylic or PLEXIGLAS) for example. A media-bearing polisher and restorer can also be used on other finished or unfinished surfaces. In addition, a media-bearing polisher and restorer can be used to clean various surfaces as well.

Figure 1:
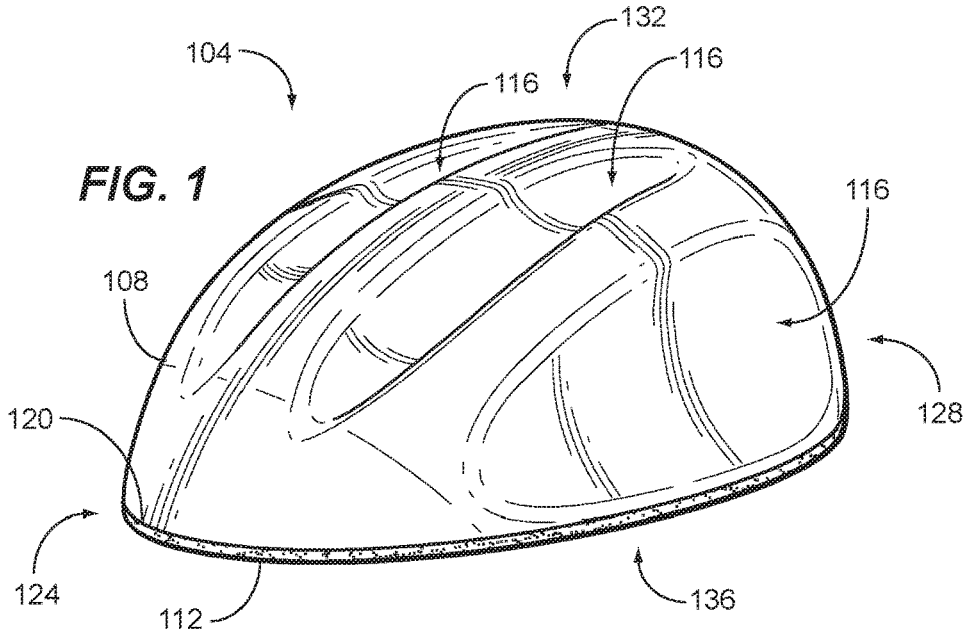
FIG. 1 is a perspective view of an exemplary media-bearing polisher and restorer.

FIG. 1 is a perspective view of an exemplary media-bearing polisher and restorer 104. In one or more embodiments, the media-bearing polisher and restorer 104 comprises a body 108 to which a variety of media 112 may be attached. The body 108 may be shaped to receive a user's hand, include one or more flutes 116 that receive one or more of a user's fingers, or both.

For instance, the body 108 may be shapes as or similar to an upper hemisphere of an ovoid shape. This causes the body 108 to have a contoured shape with a flat or planar bottom 120. The medium 112 is attached to the bottom 120 of the body 108. In this manner, the media-bearing polisher and restorer 104 comprises a contoured top portion 132 with a planar bottom portion 136.

Figure 2:
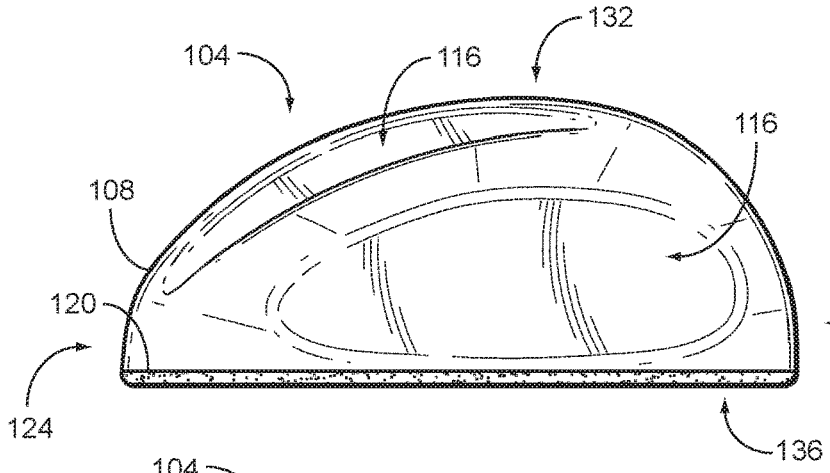
FIG. 2 is a side view of an exemplary media-bearing polisher and restorer.

Referring to the side view of FIG. 2, it can also be seen that the hemispherical ovoid shape of the body 108 may be biased toward a back end 128 of the media-bearing polisher and restorer 104. Namely, the body 108 may be enlarged along a vertical axis towards its back end 128. This provides a raised portion for receiving a user's palm at the back end 128, and a front portion that curves downward at the front end that allows a user's fingers to naturally curve inward onto the front end 124 of the body 108.

Figure 3:
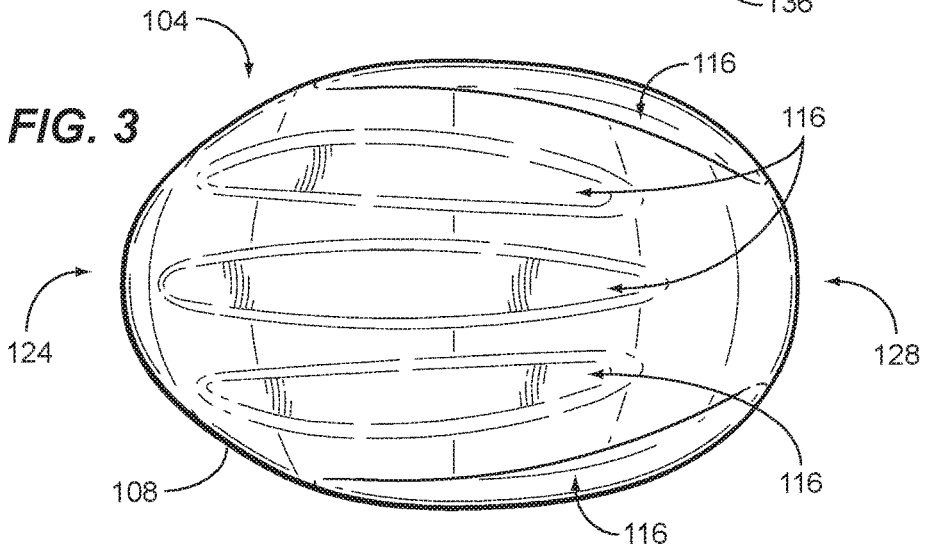
FIG. 3 is a top view of an exemplary media-bearing polisher and restorer.

Similarly, the body 108 may also taper or otherwise become narrower along a horizontal axis, such as can be seen in the top view of FIG. 3. Namely, the body 108 may have a thinner or narrower front end 124 relative to its back end 128. This also provides an enlarged area to receive a user's palm while allowing the user's fingers to curve inward onto the front end 124.

As noted above, the body 108 may include fluting 116 such as in the form of one or more grooves, cavities or indentations that receive one or more of a user's fingers. As can be seen from FIGS. 1-3, one or more flutes 116 may be located laterally across the top end 132 and sides of the body. A flute 116 will typically oriented such that it extends from the back end 128 to the front end 124 of a media-bearing polisher and restorer 104. Each flute 116 can receive a finger in this manner when grasped by a user.

In operation, each flute 116 defines finger positioning for a user. This is advantageous in that it ensures that the media-bearing polisher and restorer 104 is properly grasped by a user. Namely, the finger positioning facilitates application of even pressure from a user's hand during use. This is advantageous in that even pressure helps ensure that the media-bearing polisher and restorer's media 112 removes contaminants without overly abrading any particular area of a vehicle surface. As can be seen from FIGS. 1-3 for instance, a media-bearing polisher and restorer 104 would be engaged over a substantial portion of its ovoid hemisphere by a user's hand. This allows force or pressure from the user's hand to be received and transferred evenly to the bottom end 136 of a media-bearing polisher and restorer 104, where its medium 112 is applied to a vehicle surface.

Figure 4:
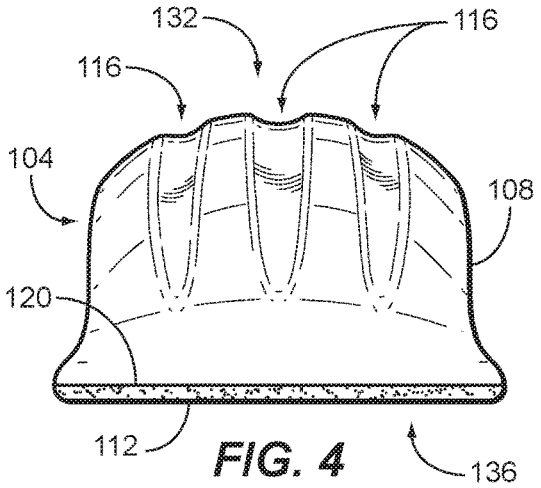
FIG. 4 is a front view of an exemplary media-bearing polisher and restorer.
Figure 5A:
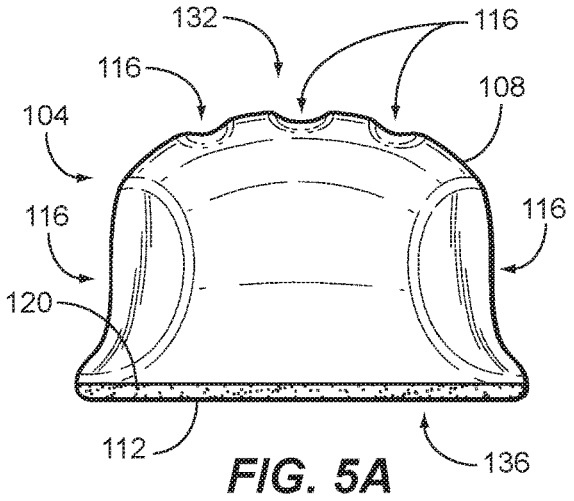
FIG. 5A is a back view of an exemplary media-bearing polisher and restorer.

FIGS. 4 and 5A respectively illustrate front and back views of an exemplary media-bearing polisher and restorer 104. A body 108 comprising a fluted ovoid hemisphere for receiving a user's hand as described above can be seen from these views as well.

Typically, a body 108 of a media-bearing polisher and restorer 104 will be formed with one or more resilient or flexible materials. In one embodiment for instance, a body 108 will be formed with high-density closed cell foam. The high-density foam can receive force or pressure from a user's hand and transfer this force to a vehicle surface while also compressing or flexing to prevent over application of pressure (which may cause over abrasion). This is advantageous in that it allows the media-bearing polisher and restorer 104 to be used at curved or otherwise contoured portions of a vehicle surface as well as vehicle surface points or edges. Moreover, closed cell foam resists infiltration by moisture or other fluids.

Figure 5B:
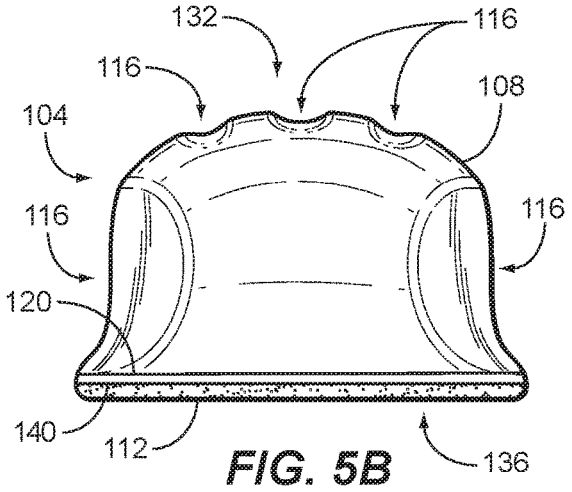
FIG. 5B is a back view of an exemplary media-bearing polisher and restorer.

Other exemplary resilient materials that may be used include rubber, silicone and sponge. In addition, it is contemplated that rigid materials may be used to form a body 108 in some embodiments. Some exemplary rigid materials include plastic, wood or metal. It is noted that in a rigid embodiment, an optional resilient pad 140 may be between the bottom 120 of the body 108 and a medium 112 to provide some flexibility to the medium when applied to a surface. This is illustrated in FIG. 5B. Though shown attached at the bottom 120 of a media-bearing polisher and restorer, it is contemplated that a resilient pad 140 may form the bottom of a media-bearing polisher and restorer. Some exemplary materials for constructing a resilient pad 140 include foam, rubber, silicone and sponge.

Figure 6:
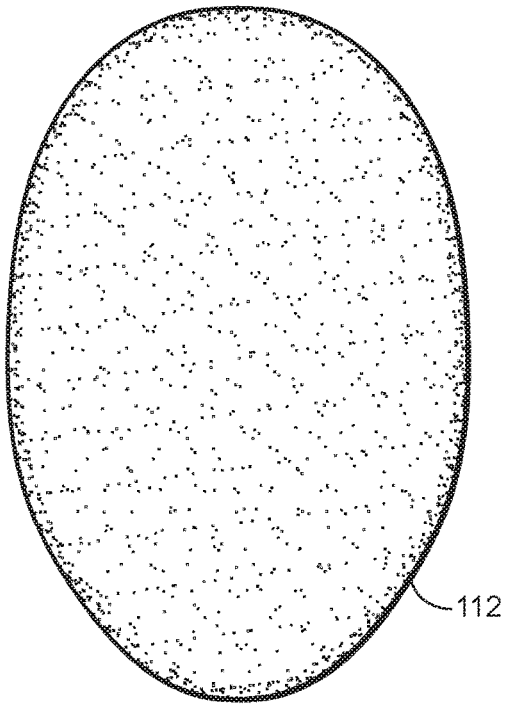
FIG. 6 is a bottom view of an exemplary medium of a media-bearing polisher and restorer.

FIG. 6 illustrates a bottom view of an exemplary medium 112 of a media-bearing polisher and restorer 104. As can be seen, the medium 112 has been illustrated with stippling to indicate a mildly abrasive quality, which helps to polish vehicle surfaces. In addition, a medium 112 will typically have an elastic quality and be permeable or absorptive to receive, capture and extract contaminants from a vehicle surface. This permits penetration of a medium 112 by a containment, which is then captured in the medium and subsequently removed. Some exemplary materials for forming various media 112 for use with the media-bearing polisher and restorer include, clay, rubber and silicone. Typically, the elastic material of a medium 112 will have abrasive particles embedded therein to give the media its abrasive quality.

Referring back to FIG. 2, it can be seen that a medium 112 may have a planar structure. Referring to FIGS. 1 and 6, it can be seen that a medium 112 may conform to the peripheral shape of the media-bearing polisher and restorer 104 at the bottom 120 of its body 108. This gives a medium 112 a pad-like structure at the bottom 120 of a media-bearing polisher and restorer's body 108.

Figure 7A:
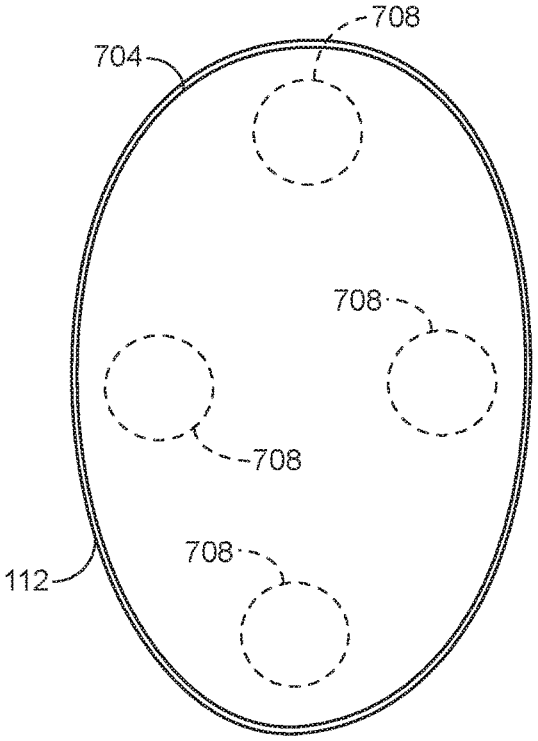
FIG. 7A is a top view of an exemplary medium of a media-bearing polisher and restorer.

FIG. 7A illustrates a proximal side of an exemplary medium 112. One or more fasteners 704, 708 for securing a medium 112 will typically be located at the proximal side of the medium. When such fasteners 704, 708 are mated with corresponding fasteners, structures or mechanisms of a body 108, a medium 112 is held in place (such as can be seen from FIG. 1). Typically, media 112 will be secured in a removable fashion.

A variety of fasteners 704, 708 may be used. For example, in the exemplary embodiment of FIG. 7A, one portion of a hook and loop fastener 704 is shown at the proximal side of a medium 112 (with its corresponding portion being at the bottom of the media-bearing polisher and restorer's body 108. This allows a medium 112 to be securely attached but also removable, such as to replace or replenish the medium. It is noted that a medium 112 may be removed so that other media having different characteristics may be attached. For example, if a medium 112 with higher, lower or no abrasive qualities is desired, or if media with higher or lower elasticity or plasticity is desired such a medium may be selected and attached to a media-bearing polisher and restorer 104 for use.

FIG. 7A also illustrates exemplary and optional fasteners 708 in the form of protrusions or nubs that extend outward into corresponding openings in the body 108. These protrusions may be secured by a friction or snap fitting. Other exemplary fasteners include suction cups, magnets, screws, pins, clips, and clamps. It is noted that a single type of fastener, such as hook and loop fastener, will typically be sufficient to secure a medium 112 to its media-bearing polisher and restorer 104.

Figure 7B:
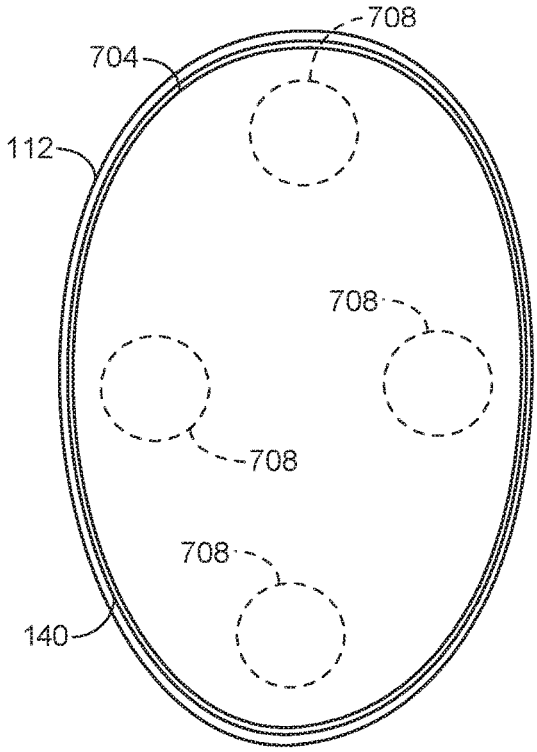
FIG. 7B is a top view of an exemplary medium of a media-bearing polisher and restorer.

In embodiments with a rigid body 108, a resilient pad 140 may form the proximal side of a medium 112, such as shown in the embodiment of FIG. 7B. One or more fasteners 704, 708 may then be used to secure the resilient pad 140 and medium 112 to the bottom 120 of a rigid body 108, such as described above.

Though illustrated as having a medium 112 of larger size than its fastener 704 in FIG. 7A, and as having a medium of larger size than both its resilient pad 140 and fastener 704, it is noted that each of these elements may have the same size in one or more embodiments. In addition, these elements may be individually increased, decreased or made equivalent in size within the spirit and scope of this disclosure. For example, with reference to the embodiment of FIG. 7B, it is contemplated that a fastener 704 and resilient pad 140 may be of an equal size while their associated medium 112 is larger.

Figure 8:
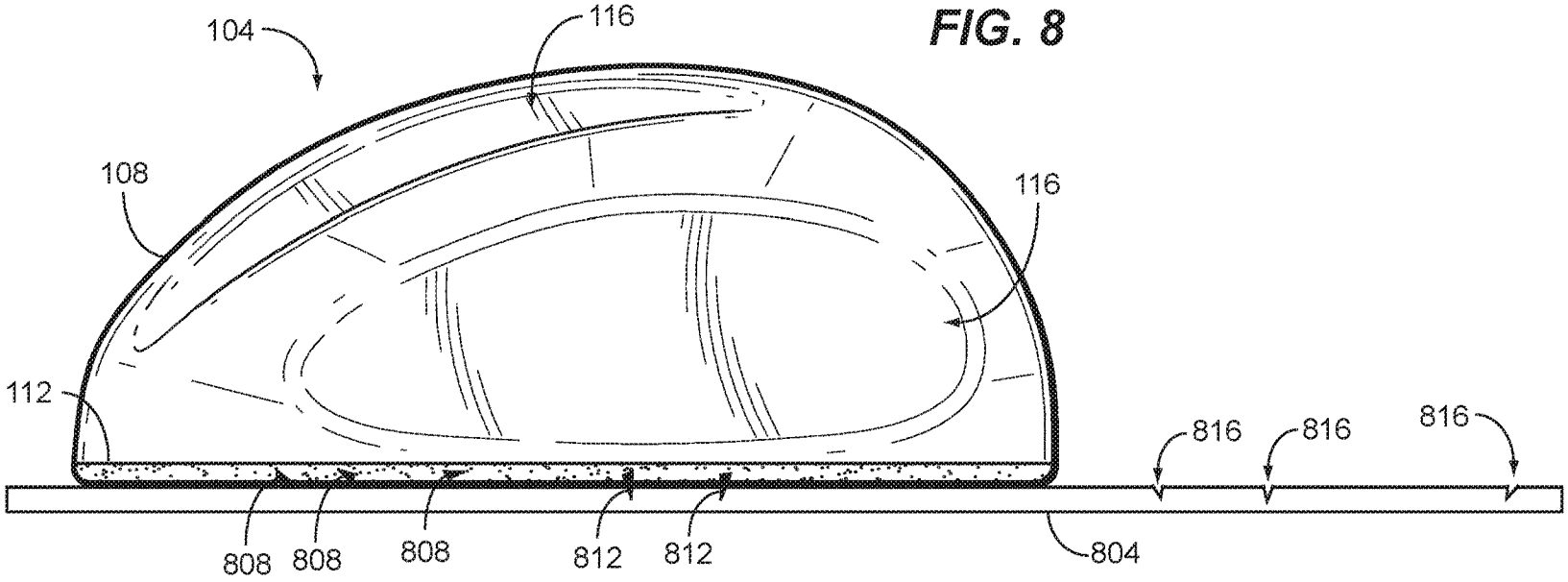
FIG. 8 is a side view of an exemplary media-bearing polisher and restorer in use.

Operation of a media-bearing polisher and restorer 104 will now be described with regard to FIG. 8. FIG. 8 illustrates a side view of an exemplary media-bearing polisher and restorer 104 on a vehicle surface 804, such as a painted, coated, or other surface. As shown, the media-bearing polisher and restorer 104 has removed a number of contaminants 808 (drawn in large scale for purposes of illustration) from the vehicle surface 804, which are now captured within the medium 112 of the media-bearing polisher and restorer.

These contaminants 808 impacted the vehicle surface 804 and formed perforations 816 in the vehicle surface. Ordinarily, cleaning would leave these contaminants in place. However, the media-bearing polisher and restorer's medium 112 removes these contaminants by allowing the contaminants to enter or penetrate its surface. The contaminants are captured by the medium 112 and subsequently removed with movement of the media-bearing polisher and restorer 104.

This operation shown by contaminants 812 of FIG. 8, which are still lodged in the vehicle surface 804. As can be seen, these contaminants 812 have penetrated the medium 112 and will be removed from the vehicle surface 804 as the media-bearing polisher and restorer 104 is moved along the vehicle surface. If desired, the perforations 816 left behind by extracted contaminants can then be filled with wax or other filling compounds to restore the vehicle surface 804.

It is noted that the media-bearing polisher and restorer 104 also removes surface contaminants that may not be removed by ordinary polishing compounds or cleaning processes. This is because its various media 112 may optionally contain abrasive compounds or particles that can remove surface contaminants that have attached themselves firmly to a vehicle surface.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A media-bearing polisher and restorer for one or more vehicle surfaces comprising:

a body having an ovoid shape with a planar bottom;

one or more flutes formed in an exterior surface of the body at the top of the body; and one or more media at the planar bottom having an ovoid shape, the one or more media comprising an elastomeric material having a continuous non-abrasive surface for application to the one or more vehicle surfaces.

2. The media-bearing polisher and restorer of claim 1 further comprising a resilient pad between the one or more media and the planar bottom.

3. The media-bearing polisher and restorer of claim 1, wherein the one or more media comprise one or more contours to correspond to a portion of the one or more vehicle surfaces.

4. A media-bearing polisher and restorer for one or more vehicle surfaces comprising:

a body having an ovoid shape with a planar bottom;

one or more flutes formed in an exterior surface of the body at the top of the body; and one or more media at the planar bottom of the body and having a shape corresponding to the planar bottom, the one or more media comprising an elastomeric material having a continuous non-abrasive surface for application to the one or more vehicle surfaces.

5. The media-bearing polisher and restorer of claim 4 further comprising a resilient pad between the one or more media and the planar bottom.

* * * * *